United States Patent [19]

Madl, Jr.

[11] 4,279,109

[45] Jul. 21, 1981

[54] ACCESS FLOOR MOUNTING ASSEMBLY

[76] Inventor: Joseph Madl, Jr., 2161 Vista Entrata, Newport Beach, Calif. 92660

[21] Appl. No.: 42,546

[22] Filed: May 25, 1979

Related U.S. Application Data

[63] Continuation-in-part of Ser. No. 796,161, May 12, 1977, abandoned.

[51] Int. Cl.[3] ..... E04F 15/024

[52] U.S. Cl. ..... 52/263

[58] Field of Search ..... 52/263, 126; 174/48

[56] References Cited

U.S. PATENT DOCUMENTS

| | | | |
|---|---|---|---|
| 3,025,934 | 3/1962 | Spiselman et al. | 52/126 |
| 3,616,584 | 11/1971 | Sartori et al. | 52/126 |
| 3,811,237 | 5/1974 | Bettinger | 52/126 |
| 4,085,557 | 4/1978 | Tharp | 52/126 |

FOREIGN PATENT DOCUMENTS

| | | | |
|---|---|---|---|
| 876117 | 8/1961 | United Kingdom | 52/126 |
| 1173666 | 12/1969 | United Kingdom | 52/126 |
| 1430232 | 3/1976 | United Kingdom | 52/126 |

*Primary Examiner*—James L. Ridgill, Jr.

*Attorney, Agent, or Firm*—Knobbe, Martens, Olson, Hubbard & Bear

[57] ABSTRACT

An assembly for mounting access flooring over a permanent surface is comprised of a plurality of supporting pedestals. Each pedestal carries an upper panel support plate and each plate has a plurality of precisely dimensioned indexing members rigidly fastened thereto, one of said members being precisely positioned adjacent each corner of the plate. Each of the floor panels is provided with a precisely dimensioned indexing member receiving aperture on the underside thereof adjacent each corner of the panel. Upon aligning and securing a small number of the pedestals over the permanent surface over which the access flooring is to be mounted, and mounting flooring panels on the aligned and affixed pedestals by firmly engaging the indexing members into the indexing member receiving apertures in the panels, the remainder of the pedestals and floor panels are self-aligned for easy mounting over the remainder of said permanent surface. Moreover the precision fit between the panels and the support plates resulting from the precision dimensioning of the indexing members and the member-receiving apertures causes the access flooring to act as a structural diaphragm, thereby strongly resisting horizontal and vertical movement of the panels due to horizontal loads.

10 Claims, 10 Drawing Figures

ACCESS FLOOR MOUNTING ASSEMBLY

CROSS REFERENCE TO RELATED APPLICATION

This application is a continuation-in-part of application Ser. No. 796,161, filed May 12, 1977, now abandoned.

BACKGROUND OF THE INVENTION

The present invention relates to an assembly for providing a strong and durable access flooring over a permanent surface which is self-aligning and easy to install. It is currently the practice in installing access flooring for use in computer rooms, large office spaces and the like to employ a combination of pedestal supports and panels wherein loosely fitting lugs extend between the pedestal supports and the panels to prevent a panel from sliding off its support. While such systems do provide access to the sub-floor, they have several disadvantages. Due to the imprecise alignment of the individual panels in such a system, installation is a difficult and time consuming process. The entire grid system must be precisely laid out prior to mounting of the panels and the work commences in one corner and then along two walls. The error in alignment of the individual panels is cumulative and a large number of the perimeter panels must be trimmed to size. Trimmed panels are, of course, not generally reusable and result in waste and economic loss. Such systems are also generally dependent on walls for perimeter retention which creates additional problems in construction as building walls are rarely, if ever, truly square.

Another system currently used employs elongated stringers to achieve lateral strength and greater retention of the panels. However, such systems generally suffer from the same disabilities as the former in that they still do not provide precise dimensional control in the lateral directions and further greatly limit the access to the sub-floor creating undesirable interference and possible injury to personnel and making it considerably more difficult to run electrical wiring beneath the access flooring due to the large number of obstructions caused by the supporting stringers.

In addition to the difficulties encountered in assembling the access flooring systems heretofore available, the imprecise mounting of the individual panels often results in a shifting or lateral displacement of the panels during use. In fact, during large installations it is often necessary to barricade the working area to prevent overnight shifting of the partially completed work. As a result of this shifting, if a panel ever needs to be replaced, this lack of dimensional control makes replacement of a single panel quite difficult and often times impossible, thereby generating a major replacement operation. In present access flooring systems, panels are generally removed and replaced in a cocked and tilted position. This can create much damage to the trim edge during normal removal and replacement of panels as a result of highly localized pressures against the trim edge. The lack of lateral stability results in non-uniform clearances between panels and an abnormally tight fit, resulting from shifting, very much increases the possibility of damage to the trim edges in the normal removal and replacement of panels. Another problem often encountered with the aforesaid assemblies is the difficulty of maintaining an air-tight seal between adjacent panels, resulting in an uneven air distribution.

While systems for supporting access flooring are currently available which do not employ elongated stringers, and consequently avoid the above obstruction problem, such systems again do not provide any means by which the panels can be precisely aligned, and, consequently, all of the above problems resulting from such imprecise alignment are encountered and in addition, these systems offer very little lateral stability. It would be highly desirable to provide an economical assembly which includes means for precisely aligning the individual panels in access flooring, thereby greatly simplifying installation, as well as providing superior access flooring. The present invention provides such an assembly.

SUMMARY OF THE INVENTION

Briefly, the invention herein relates to an assembly for mounting access flooring over a given surface. The assembly is comprised of a plurality of floor panels and a plurality of panel supporting pedestals. Each of the pedestals has an upper support plate secured thereto and alignment means are precisely positioned on said plates adjacent each corner thereof which cooperate, in a precision-fit manner, with means disposed on the underside of said panels adjacent the corners thereof to precisely align the pedestals and floor panels carried thereby over said surface and provide a strong, durable, and laterally stable access flooring, which acts as a structural diaphragm to resist horizontal movement of the panels when they are subjected to a lateral load.

It is the principal object of the present invention to provide an improved assembly for mounting access flooring.

It is another object of the present invention to provide an assembly for mounting access flooring which is continuously self-aligning to provide uniform air-tight fittings between adjacent panels.

It is yet another object of the present invention to provide an assembly for mounting access flooring which interlocks adjacent floor panels to provide lateral stability and prevent shifting thereof.

It is still another object of the present invention to provide an assembly for mounting access flooring which provides lateral stability and easy unrestricted access to the sub-floor with the removal of only a few panels.

It is a further object of the present invention to provide an assembly for access flooring which does not depend on room walls for perimeter retention.

It is a still further object of the present invention to provide an assembly for mounting access flooring which is of simple construction and economical to manufacture.

It is still another object of the present invention to provide an assembly for access flooring which is easily installed.

It is yet another object of the present invention to provide an assembly for access flooring which greatly reduces the likelihood of damage to a trim edge during panel removal and installation and when the panels are subjected to lateral forces.

Another object of the present invention is to provide resistance to vertical uplift in the magnitude of 2 to 3 times gravity.

Another object of the present invention is to provide accurate predictable overall dimensions of any size installation in 2 horizontal axes.

These and other objects and advantages of the present invention will become apparent from the following detailed description taken in conjunction with the accompanying drawings.

DETAILED DESCRIPTION OF THE INVENTION

Figure 1:
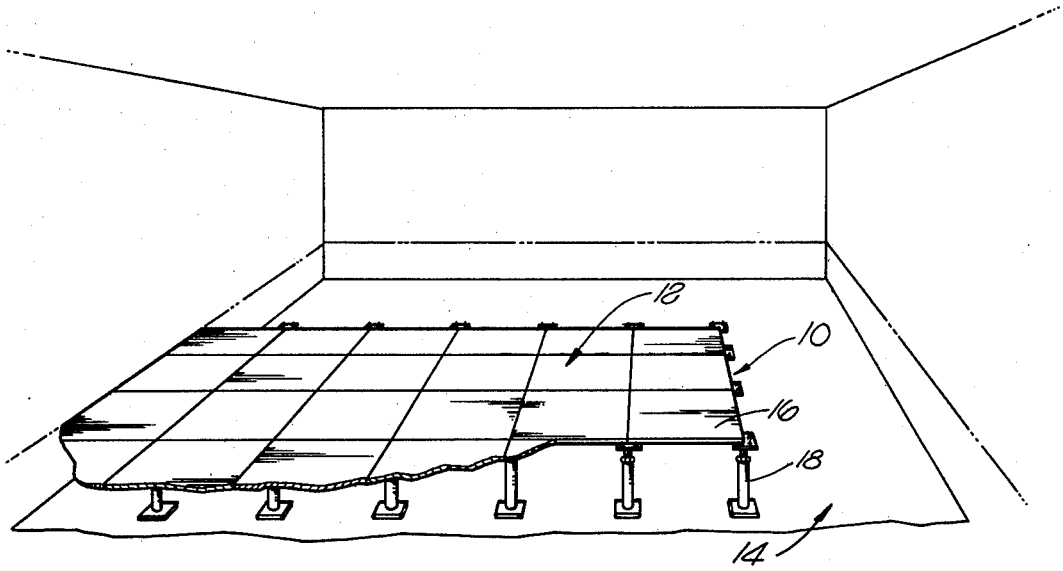
FIG. 1 is a perspective view of a portion of an access floor constructed according to the present invention.

Referring now in detail to the drawings, the assembly 10 for mounting access flooring 12 over a given surface 14 is seen to be comprised of a plurality of floor panels 16 and a plurality of panel supporting adjustable pedestals 18. Each pedestal is comprised of a base portion 20, a columnar support 22, a threaded telescopic extension 24, a locking cap 26, and a square support plate 28 which is carried by the extension 24. It can be seen that by varying the protrusion of the threaded extension 24 from the columnar support 22 and securing the locking cap 26, the height of the support plate 28 can be adjusted.

Figure 3:
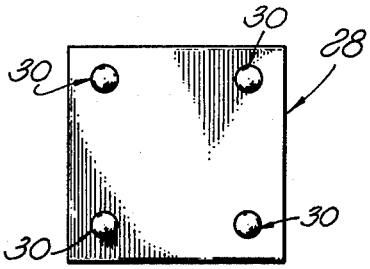
FIG. 3 is a top view of a support plate.
Figure 8:
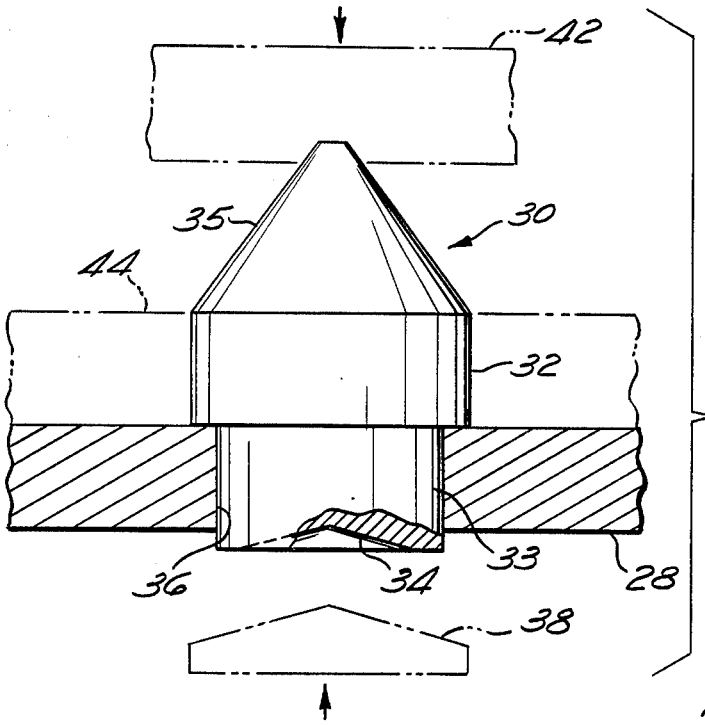
FIG. 8 is a diagrammatic representation of the process of mechanically locking an indexing member of the present invention into a support plate.
Figure 9:
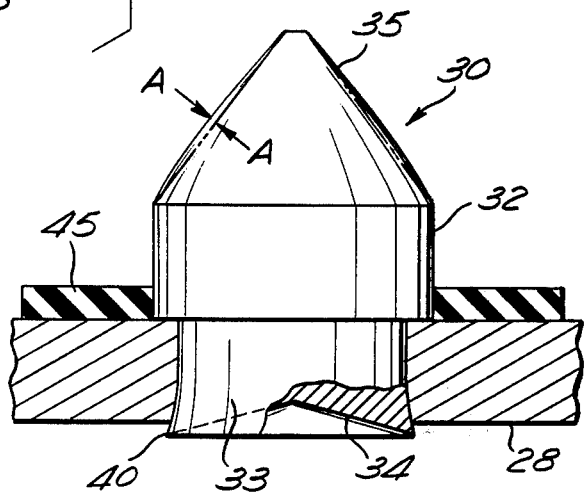
FIG. 9 is a detailed elevational view, partly in section, showing the rigid connection between the indexing member and the support plate after the mechanical locking process is completed.

Each support plate 28 has four indexing members or pins 30 extending upwardly from the plate adjacent the corners thereof. As shown in FIG. 3, the pins are equidistantly spaced from one another to define a square configuration. As best shown in FIGS. 8 and 9, each of the pins 30 comprises a cylindrical body 32 of a precisely controlled diameter. Extending downwardly from the body 32 is a reduced-diameter cylindrical shaft 33 having a conical depression 34 in the bottom thereof. Extending upwardly from the body 32 is a tapered portion 35 in the form of a truncated right cone or frustum.

For reasons which will soon be made clear, the pins 30 are rigidly attached to the plate 28 in a manner which allows the plate 28 and the pins 30 to become, in effect, an integral unit, with substantially no room for relative movement therebetween. This effect is accomplished by the process of mechanically locking the pins 30 into the plate 28, as diagrammatically illustrated in FIG. 8.

As the first step in the attachment process, holes 36 are precision drilled in precise locations adjacent the corners of the plate 28. The diameter of these holes is controlled to a tolerance of $\pm 0.001$ inch, as is the distance between the center lines of the holes relative to one another, including the diagonal distance. The body 32 and the shaft 33 of the pins 30 are machined to the same tolerance, so that the shaft 33 can be inserted into the holes 36 with a snug frictional fit, while the diameter of the body 32 is made very precise.

Next, the pins 30 are positioned into the holes 36 with the above-mentioned snug frictional fit. As shown in FIG. 8, the shaft 33 is slightly longer than the thickness of the plate 28, so that a portion of the shaft 33 extends from the bottom of the plate 28.

Mechanical locking of the pins 30 into the plate 28 is accomplished by a punch press of appropriate tonnage. The punch has a male die 38 (shown diagrammatically in dotted outline in FIG. 8), which conforms to the conical depression 34 in the bottom of the shaft 33. This conformance between the die 38 and the depression 34 permits the die 38 to strike the bottom of the shaft 33 in the center thereof, pushing the metal of the shaft outwardly about the perimeter thereof fusing the metal against the wall of 36 and forming a flange 40 (FIG. 9) which locks the pin 30 in the hole 36 so as to resist movement from both lateral loads and vertical forces, in effect making the pin 30 and the plate 28 the functional and structural equivalent of an integral unit.

During the locking process, a top female die 42 is positioned against the top of the conical portion 35 of the pin 30 to maintain the seating of the pin 30 in the hole 36. A lateral female die 44 is seated snugly against the sides of the cylindrical body 32 to prevent deformation of this part of the pin as the male die 38 strikes. Thus, all relieving of material occurs in the non-critically dimensioned tapered portion 35 of the pin, as shown by the line A—A in FIG. 9. As a result, the diameter of the cylindrical body 32 is maintained within the aforementioned tolerances.

As a result of this mechanical locking process, the pin 30 is perfectly aligned perpendicular to the plate, and, since the plate and the pin have become, in effect, an integral unit, these two elements are, by definition, in constant, intimate contact. Moreover, the pins are precisely located in their respective positions on the plate.

A compressible sound and vibration absorbing washer 45 is advantageously provided around the lower perimeter of the body 32 of the pin 30, near the juncture with the plate 28.

Figure 5:
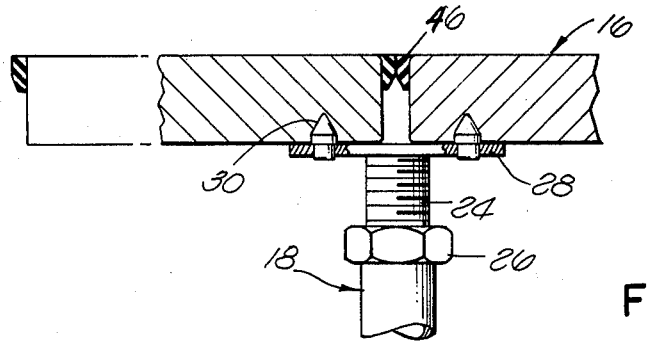
FIG. 5 is an end view of a portion of an access flooring constructed according to the present invention.
Figure 10:
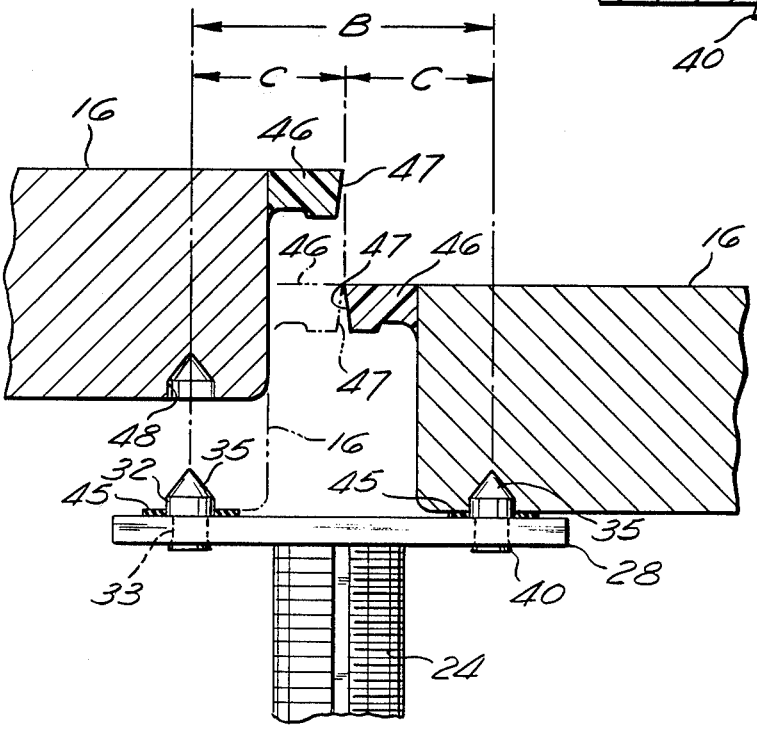
FIG. 10 is a detailed sectional view showing the engagement between the various elements of the invention.

The floor panels 16 of the present invention which are mounted on the pedestals 18 are preferably of metal construction or other electrically conductive material, but could also be constructed of a plastic, wood or composite material and are often provided with a tapered edge trim 46 around the perimeter of the panels near the top surface thereof. The edge trim 46 is preferably constructed of a plastic material (FIGS. 5 and 10). The edge trim 46 serves both decorative and functional purposes. In addition to its obvious decorativeness, the trim prevents metal to metal contact between adjacent floor panels, and its tapered or chamfered leading surface 47 (FIG. 10) provides a reduced area of contact between adjacent panels, thereby maintaining an airtight seal between the panels to prevent air drafts or uneven air distribution while facilitating the installation and removal of a floor panel by reducing the area of contact therebetween.

Figure 4:
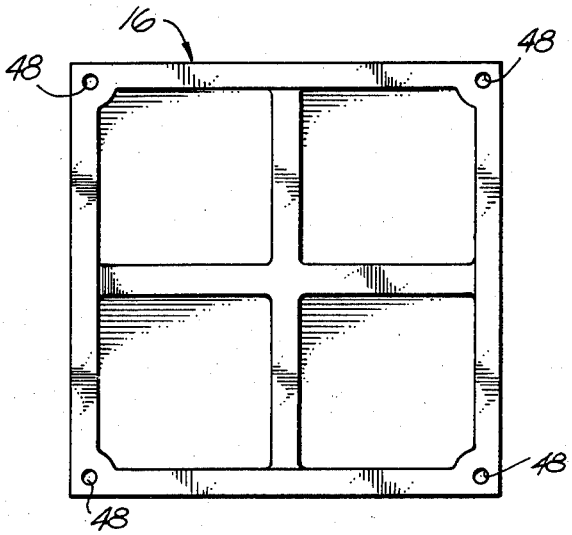
FIG. 4 is a view of the underside of a floor panel.

As best seen in FIG. 4, the underside of each floor panel 16 is provided with an indexing member receiving aperture 48 adjacent each corner thereof. The panel is shown as solid material but could be cellular or other configurations. The apertures 48 are precision drilled to have a diameter which is 5–7 mils larger than the diameter of the body 32 of the pins 30 so as to snugly receive the pins. Also, the apertures 48 are precisely located in the panel 16 by maintaining close tolerances in the distances between the apertures, including the diagonal distances, all of which are held to ±0.001 inch. Because of distortion created in forming and welding the panels, the apertures 48 are drilled after the panels have been fully fabricated. The drilling fixture used to drill the apertures compensates in two ways for those dimensional variations which occur even in die produced panels. First, the fixture provides equal tension and pressure on all four sides of the panel, so that the total tolerance variation in each panel is always equally divided. Thus, for example, a six mil variation in panel dimension is reduced to a 3 mil variation on each side of the center. Secondly, if the panels produced in a particular die run consistently exceed or are less than normal manufacturing tolerances, the drill fixture is provided with different drill guides which slightly increase or decrease the distance between the apertures 48, as appropriate for that run, but still maintaining for each panel in the entire system uniform distance between the apertures 48 within the ±0.001 inch tolerance.

During the mounting of the access flooring, one pedestal supports the corners of four floor panels as seen in FIG. 1, with the four indexing pins 30 carried by the pedestal extending into the receiving apertures 48 located at the corners of the four panels. In this manner, continuous precision alignment of the floor panels and adjacent pedestals is assured to prevent the accumulation of error found in the prior art. This precise panel alignment obtained by assembly 10 and the close fit between the body 32 of the pins and the aperture 48 allows the panels to be placed on or lifted from the pedestal supports solely in a precisely vertical direction. Accordingly, the damage to the trim edge is prevented not only in the case of laterally shifting panels (due to the enlarged area of uniform contact as opposed to the irregular concentrated contact points found in the prior art which generate high destructive forces), but particularly in the removal and replacement of panels as well, since the panels cannot be tilted or cocked during the installation and removal, such tilting and cocking being normal practice in prior art systems.

This precision panel alignment is best illustrated in FIG. 10. As shown, the panel 16 on the right side of the drawing is in place on one of the pins 30 in the plate 28. The cylindrical body 32 of the pin 30, having a very slightly smaller diameter than the receiving aperture 48 in the panel, maintains a tight frictional contact with the walls of the aperture, thereby minimizing the amount of "play" therebetween, so that at least a substantial portion of the body 32 is always in intimate contact with the panel 16. The stabilizing effect of the frictional contact is augmented by the same interfit at a total of four locations on each panel.

The panel 16 on the left in FIG. 10 is shown in the process of being installed adjacent to the right-hand panel. The tapered portion 35 of the pin 32 permits quick rough positioning of the panel leading to prompt alignment of the panel into exact final position. The tapered surface 47 of the edge trim 46 permits firm seating of the panel on the body 32 of the pin 30 before frictional contact is made with the edge trim of the adjacent panel, thus minimizing the chance of damage to the trim during installation.

Because of the precise positioning of the pins 32 in the plate 28, (dimension "B" in FIG. 10), and the precise locations of the receiving apertures 48 with respect to each other on the panels 16, the leading edges of the edge trims 46 between adjacent panels will always meet substantially at the center line between a pair of pins 32 on a plate 28, as shown by the dimension "C" in FIG. 10. This results in the precise panel alignment mentioned above, as well as a precisely defined vertical lifting track which allows the panels to be lifted only by a force which is solely vertical. Furthermore, an extremely precise and uniform spatial relationship is created between the panel 16 and the plates 28, which in turn, allows for a precise and uniform spatial relationship between adjacent panels.

The above-described spatial relationships produce several advantages, when the flooring assembly is laid out in the manner which will subsequently be described:

(a) The engagement between the panels 16 and the plates 28 automatically creates the proper horizontal alignment of the flooring assembly.

(b) The panels remain locked in a uniform, correct grid position, with shifting during or after installation being substantially eliminated.

(c) As each panel is lowered to its final position along the above-mentioned precisely defined vertical track, contact is made with the edge trims of adjacent panels, which contact is uniform about the panel's perimeter. A nearly air-tight fit between adjacent panels is thus produced because of this uniform trim edge contact.

(d) The panels are retained at the perimeter without pedendency on the walls for retention, thereby substantially eliminating the problems which result from walls which are not on a true square.

Figure 6:
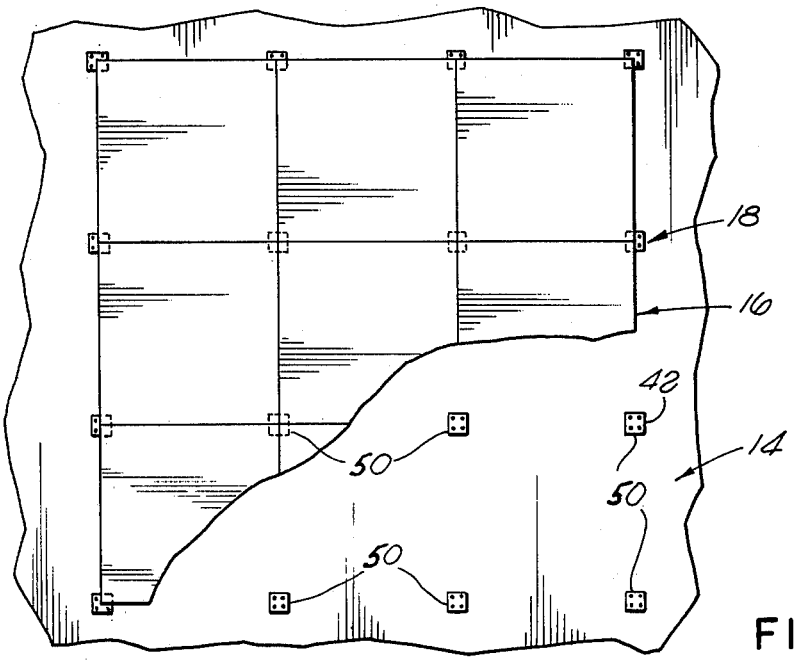
FIG. 6 is a plan view of the access flooring of the present invention with the initial pedestals and floor panels carried thereby in place for the alignment of the remaining pedestals and floor panels.

To construct an access flooring according to the present invention, an area of the sub-floor of a given dimension over which the access flooring is to be constructed is first designated. One then need only locate the center of that area and accurately align in a conventional manner a configuration of supporting pedestals 18 and floor panels 16 which dictates the proper angular alignment of those and all of the remaining panels. A "T" configuration or, as shown in FIG. 6, a square configuration comprising nine panels will properly align for installation all of the remaining pedestals and panels within the designated area, as such configurations, once secured, dictate such alignment along the two perpendicular axes normal to the walls. When such alignment has been made, pedestals and panels are added until the panels extend between the opposite walls defining the given area or surface 14, and a number of controlling pedestals, designated 50, are secured to the surface 14 by bolt means or other suitable fasteners. If a "T" configuration is employed, it should be minimum two panels wide and minimum two pedestals on each leg of the "T" would need to be so secured.

Figure 2:
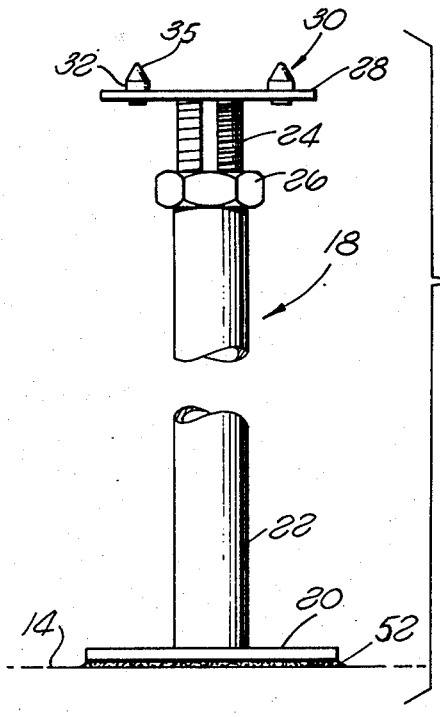
FIG. 2 is a side view of a pedestal and support plate.

With the square configuration illustrated in FIG. 6, about six pedestals should be so initially secured, although a different number may prove equally sufficient as long as the panel positioning along the two perpendicular horizontal axes is dictated by the secured pedestals. A slow setting thixotropic adhesive 52 (see FIG. 2) is disposed under each of the pedestals for securing the pedestals to the surface 14 and for supporting the control pedestals 50 while they are secured to the surface 14. A rubber based adhesive of the long bonding range type has proved highly suited for such use. A slow setting adhesive is employed so that while the positioning of the pedestals in the square or "T" configuration is adjusted during the mounting of the floor panels thereon, the pedestals can float into proper positioning. Once the indexing layout is complete, the remainder of the installation process is self-aligning as each pedestal positions four panels; and two pedestals to which a panel is secured locks that panel in place, thereby insuring extreme accuracy with little effort. If a pedestal is not properly positioned, the panel will not fit thereon, i.e., the receiving apertures 48 on the floor panel will not align with pins 30 on the support plate. Any such misalignment can be readily cured by sliding the misaligned pedestal into the proper position where the indexing pin carried thereon will mate with the receiving aperture in the respective floor panel. Such a procedure is in marked contrast to the prior art wherein it is necessary to initially lay out the entire floor pattern with extreme accuracy and begin assembly at one corner, butting each panel against its adjacent panel and, as the walls are rarely, if ever, properly aligned, trimming many of the perimeter panels to provide the necessary custom fitting.

The tight precision fit between each panel and the support plates 28, as described above, provides a unique structural benefit, in that the flooring assembly displays a dramatic resistance to lateral forces, without the use of grid members or stringers (which severely limit subfloor access), and without any bolting of panels.

Figure 7:
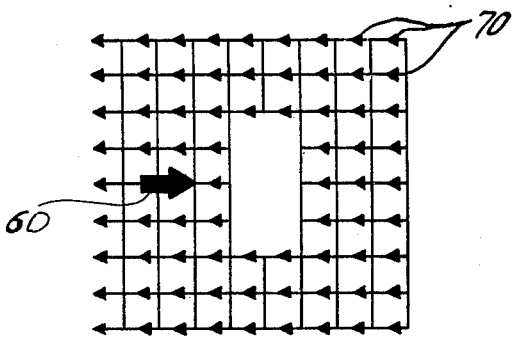
FIG. 7 is a diagrammatic view illustrating the diaphragm action of the access flooring of the present invention.

This feature is best understood with reference to FIGS. 5 and 7. When a horizontal load 60 (FIG. 7) is applied along the left edge of the left hand panel 16, for example, in FIG. 5, the load is transmitted through the panel, the left hand pin 30, the support plate 28, the right hand pin 30, and through the right hand panel 16. (It will be noted that no significant portion of the load is transmitted through the edge trims 46.)

Since the pins 30 and the plate 28 are essentially unitary, as previously described, and since the panels are in a tight, frictional engagement with the support plates, the load 60 is resisted by the interconnected panels acting as a monolithic, or unitary structure, so that load resisting forces (illustrated by arrows 70 in FIG. 7 although actually the forces in a diaphragm go in many directions in the plane of the diaphragm) are generated uniformly throughout the structure. This uniform distribution of the load-resisting forces minimizes the tendency of the panels to move in a lateral direction as a result of the lateral load 60, to the degree that the floor assembly functions as a structural diaphragm. This diaphragm behavior is demonstrated even when several central panels have been removed, as shown in FIG. 7. It has been found that substantial lateral forces applied toward such a void which would permanently deform or collapse other systems, results in zero permanent set with this system.

Moreover, the ability of the flooring assembly to function as a unitary structure (i.e., a structural diaphragm) also provides a high degree of resistance to vertical lifting (buckling) initiated by forces having a lateral component and because of its precision, resists a minimum force of 2.5 times gravity in vertical lift.

The above-described bahavior of the system is in marked contrast with prior art systems, which behave as a loose assemblage of panels, rather than as a structural diaphragm, thereby exhibiting a tendency to shift laterally and to buckle when subjected to a lateral load.

Still a further benefit resulting from the tight precision fit between the panels 16 and the support plates 28 (by means of the intimate contact between the pins 30 and the walls of the receiving apertures 48, as previously discussed) is the excellent electrical conductivity achieved throughout the floor assembly, an important consideration for the proper grounding of static electricity which can be harmful to the electro/mechanical equipment frequently installed on such floors. Thus, the fact, previously mentioned, that at least a substantial part of the body 32 of the pins 30 is always in intimate contact with the walls of the receiving apertures 48 insures that an electrical path to the ground is always provided, from a panel, through four pins engaged in the panel, to the four plates to which the pins are attached, and through the four pedestals to ground. Because electrical contact does not depend on the gravity induced mating of flat surfaces, as in the prior art, the insulating washers 45 may be inserted between the panels and the support plates, as previously described, to dampen vibration. Furthermore, the lack of dependence on gravity for electrical conductivity eliminates the chance of breaking the electrical path due to, for example, warped or non-level components, or the accumulation of insulative debris or paint between the panels and the pedestals, a problem which is not unusual in prior art systems. Thus, the structure of the present invention insures less than one ohm of resistance to ground from any point on the floor, for any size installation, even with the insulating washers 45 placed in a position which could substantially impair the electrical conductivity of prior art systems.

Finally, the flooring assembly of the present invention provides excellent transmission of dynamic load forces from the panel surfaces to the underlying structural slab, again as a result of the tight precision fit among all components.

In sum, all of the above-discussed structural, mechanical, and electrical advantages are inherently achieved by the precise positioning and tight interconnection of the system's components.

Various changes and modifications such as a reversal of the male and female relationship between the supporting plates and panels or use of the system in planes other than horizontal, such as a wall, may be made in carrying out the present invention without departing from the spirit and scope thereof. Insofar as these changes and modifications are within the purview of the appended claims, they are to be considered as part of the present invention.

What is claimed is:

1. A removable panel system, comprising:

a plurality of panels;

a plurality of pedestals, each terminating in a panel support plate;

first means, precisely positioned on the top of each of said plates;

a second means disposed on the underside of each of said panels, adjacent the edges thereof, for cooperating in a precision fit engagement with said first means; and one of said first and second means being a precisely located aperture and the other being a pin which has a tapered end portion to initially index and guide the panel and a vertical walled base portion which fits precisely and snugly in said aperture to precisely align said pedestals and said panels carried thereby over a permanent surface;

said vertical walled base portion of the pin abutting the interior wall of said aperture to resist lateral loads on said panel, said pins being spaced and dimensioned relative to the dimensions of said panels that substantially all lateral loads are transmitted through said first and second means rather than from the edge of one panel to another and so that said panels, and said plates form a structural diaphragm which resists lateral movement of said panels when said panels are subjected to a lateral load.

2. The panel system of claim 1, wherein said panels are carried on said plates and are secured thereon by said engagement between said first means and said second means, the securing of one of said panels to two of said plates precisely aligning said panel and restraining said panel against lateral movement, and the securing of several of said plurality of panels automatically aligning the remainder of said panels.

3. The panel system of claim 1, wherein said first means and said second means provide a precisely-defined removal and replacement track for said panels so that said panels can be removed and replaced only by a force which is substantially directly perpendicular to said diaphragm.

4. The access flooring system of claim 1, wherein said pins, said plates, and said panels are of electrically conducting material, and an electrical contact is maintained between said plate and said panel substantially only by frictional contact between said pins and said panel.

5. The access flooring system of claim 4, further comprising:

an insulative element between said plate and said panel.

6. The access flooring system of claim 1, wherein at least some of said panels have an edge trim around the perimeter thereof, said edge trim configured and located with respect to the bottom of said panel so that said snug fit between said panel and said pins is made before the respective edge trims on adjacent panels come into contact with one another.

7. The access flooring system of claim 6, wherein said edge trim is located near the top surface of said panel and has a leading surface tapering downward toward said panel.

8. The panel system of claim 1, wherein said first means comprises a pin extending upwardly from said plate adjacent each corner thereof, said pin having a cylindrical base portion of precisely controlled diameter; and said second means comprises a pin-receiving aperture having a precisely controlled diameter which is sufficiently close to the diameter of said cylindrical portion of said pin to create a frictional fit between the walls of said apertures and said cylindrical portion.

9. The panel system of claim 8, wherein said pin is a separate member from said plate extending through an aperture in said plate and mechanically locked to said plate to become effectively an integral unit with said plate.

10. The panel system of claim 8, wherein:

the dimension between the pins on each plate is precisely identical to that on all other plates to a tolerance of about ±0.001 inch;

the dimension between the apertures in each panel is precisely identical to that on all other panels to a tolerance of about ±0.001 inch; and said apertures in said panels are about 5–7 mils larger in diameter than said pins.

* * * * *